US005934719A

United States Patent [19]

Athanasios

[11] Patent Number: 5,934,719

[45] Date of Patent: Aug. 10, 1999

[54] EXTERNAL LOCK ASSEMBLY FOR SLIDING DOORS AND THE LIKE COOPERATING WITH A TUBULAR FRAME MOUNTED ELEMENT

[76] Inventor: Leontarides Athanasios, c/o V. Mantzikas, POB 3884, 10210 Athens, Greece

[21] Appl. No.: 08/974,647

[22] Filed: Nov. 19, 1997

[51] Int. Cl.[6] ..... E05C 19/00

[52] U.S. Cl. ..... 292/300; 292/189; 292/DIG. 46; 292/145

[58] Field of Search ..... 292/300, 302, 292/341.15, 145, DIG. 46, DIG. 47, DIG. 35, DIG. 55, DIG. 15, 183, 189

[56] References Cited

U.S. PATENT DOCUMENTS

| | | | |
|---|---|---|---|
| 419,374 | 1/1890 | Sorensen | 292/DIG. 46 |
| 818,143 | 4/1906 | Booth | 292/DIG. 46 |
| 917,969 | 4/1909 | Shinn | 292/DIG. 46 |
| 2,844,020 | 7/1958 | Chittum et al. | 292/DIG. 46 |
| 2,861,660 | 11/1958 | Ensign | 292/DIG. 46 |
| 3,012,430 | 12/1961 | Spork | 292/DIG. 46 |
| 3,025,693 | 3/1962 | Braginetz | 292/DIG. 46 |
| 3,040,555 | 6/1962 | Wartian | 292/DIG. 46 |
| 3,065,985 | 11/1962 | Du Four | 292/DIG. 46 |
| 3,120,748 | 2/1964 | Rechberg | 292/DIG. 46 |
| 3,596,954 | 8/1971 | Hull et al. | 292/DIG. 46 |
| 3,870,353 | 3/1975 | Miller | 292/DIG. 46 |
| 3,877,739 | 4/1975 | Cowen | 292/DIG. 46 |
| 3,884,514 | 5/1975 | Praska | 292/DIG. 46 |
| 4,024,739 | 5/1977 | Kaufman | 292/DIG. 46 |
| 4,068,874 | 1/1978 | Fleming et al. | 292/DIG. 46 |
| 4,160,560 | 7/1979 | Hauber | 292/DIG. 46 |
| 4,480,862 | 11/1984 | Fleming | 292/DIG. 46 |
| 4,790,157 | 12/1988 | Lin | 292/DIG. 46 |
| 5,575,321 | 11/1996 | Currier | 292/DIG. 46 |

FOREIGN PATENT DOCUMENTS

| | | | |
|---|---|---|---|
| 1286763 | 8/1972 | United Kingdom | 292/DIG. 46 |
| 1396876 | 11/1975 | United Kingdom | 292/DIG. 46 |

*Primary Examiner*—Steven Meyers
*Assistant Examiner*—Stephen Grady
*Attorney, Agent, or Firm*—Dowell & Dowell, P.C.

[57] ABSTRACT

An external lock assembly for sliding doors and the like, cooperating with a tubular frame mounted element, which has a thickness and form such as to enable it to be mounted within the limited space available in between a pair of sliding door panels (glass panel and shutter panel). The external lock assembly comprises at least one and preferably a pair of sliding bolts and effects a locked condition of the sliding door when the sliding bolts enter within a central vertical hole of the tubular frame mounted element.

5 Claims, 6 Drawing Sheets

EXTERNAL LOCK ASSEMBLY FOR SLIDING DOORS AND THE LIKE COOPERATING WITH A TUBULAR FRAME MOUNTED ELEMENT

The present invention refers to the field of the art of locksmiths in general and particularly it discloses an external lock assembly suitable for sliding doors and the like, made from whatever material. According to a more specific scope, the invention discloses the external lock especially suitable for sliding aluminum doors and the like, the external lock cooperating with a specially shaped tubular frame mounted element.

BACKGROUND OF THE INVENTION

No similar lock to the one disclosed in the present invention has ever been suggested, designed, constructed or made available to the market before.

As far as the technology of the construction of locks for sliding doors and the like is concerned, various external lock mechanisms are known that operate with a safety hook or other means.

Nevertheless, one characteristic drawback of the external lock systems of the prior art is the fact that they comprise a frame mounted element that is externally screwed on the door frame, since the standardized typical door frame profiles within which the door panels can slide, do not offer facilitation as far as the installation in the gap intermediately between them and the sliding door of the frame element under consideration is concerned. This fact together with the dimensions of the external lock itself result in failing to place such an external lock in between sliding doors with two panels (shutter and glass panel) since the space between the internal glass panel and the external panel of the shutter does not allow a sufficient gap for mounting the necessary frame mounted element. It must be noted at the same time that the locking/unlocking mechanism employed on the one hand and the form of the frame mounted element at the external locks of the prior art on the other hand, as well as the way in which the frame mounted element is fixed onto the door frame and the fact that this element is essentially a linear plate, often render the abovementioned external locks of the prior art of reduced strength and reliability.

It is therefore the main object of the present invention to effectively overcome the drawbacks and deficiencies of the prior art and to provide an external lock for sliding doors and the like, wherein the dimensions of the lock and of the frame mounted cooperating element are such that it can work with the frame element mounted even within the clearance allowed at typical profiles in between sliding doors with two panels (glass panel and shutter), the proposed external lock and cooperating frame mounted element offering the maximum security and reliability as far as its operation is concerned.

The main object of the invention under consideration is realized by a frame mounted element, which has a small thickness with respect to its surface, which allows it to be inserted and fixed at the interior of the door frame, eg. for aluminum profile series 150 and 700, and is on the one hand bent to form a plate fixed by screwing onto the door frame and on the other hand it comprises a tubular housing suitable for receiving the sliding bolt members provided at the external lock of the invention, which is mounted onto the sliding door.

These and other objects, characteristics and advantages of the present invention will become obvious at the detailed description that follows.

BRIEF DESCRIPTION OF THE DRAWINGS

The present invention will become apparent to those skilled in the art by reference to the drawings attached herewith that present the invention in an illustrative manner.

FIG. 1 is a perspective view of the suggested external lock and co-operating frame mounted element of the invention installed in a typical profile of double panelled sliding doors and the like.

FIG. 4 is a perspective view of the suggested frame mounted element and of the external lock of the invention, being dismantled at the individual parts that they consist of.

DETAILED DESCRIPTION OF THE PREFERRED EMBODIMENTS

By reference to the appended figures we will herein below describe the construction and operation of illustrative embodiments of the external lock of the invention.

As will be understood, the external lock and associated frame mounted element of the present invention can be mounted on sliding doors, windows and similar closure means for various openings. As used herein, the word (door) shall include windows and other closure means. Accordingly the expression (door frame) shall include frames for doors and windows as well as double panelled doors or windows with a glass panel and a shutter.

Figure 1:
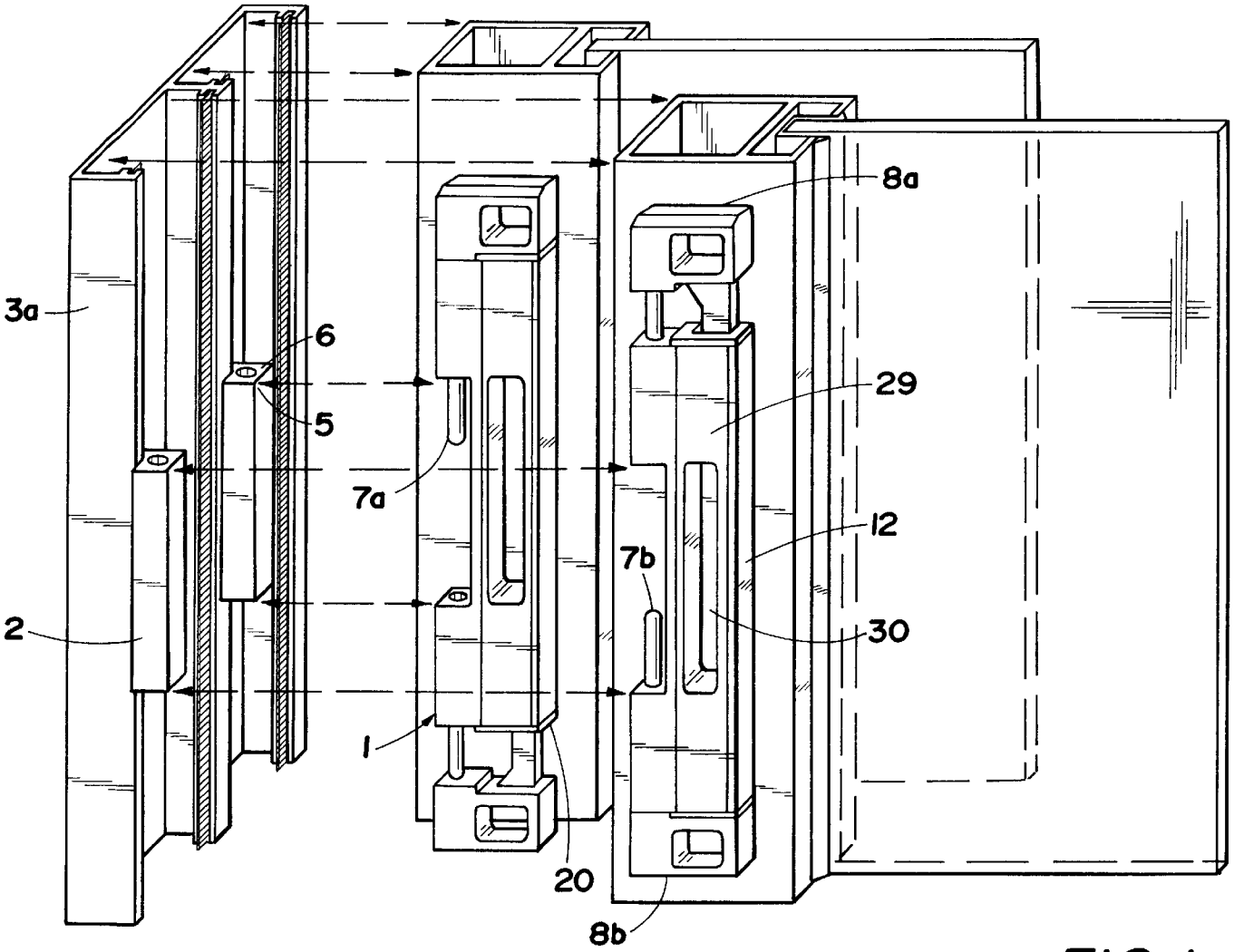
Figure 2:
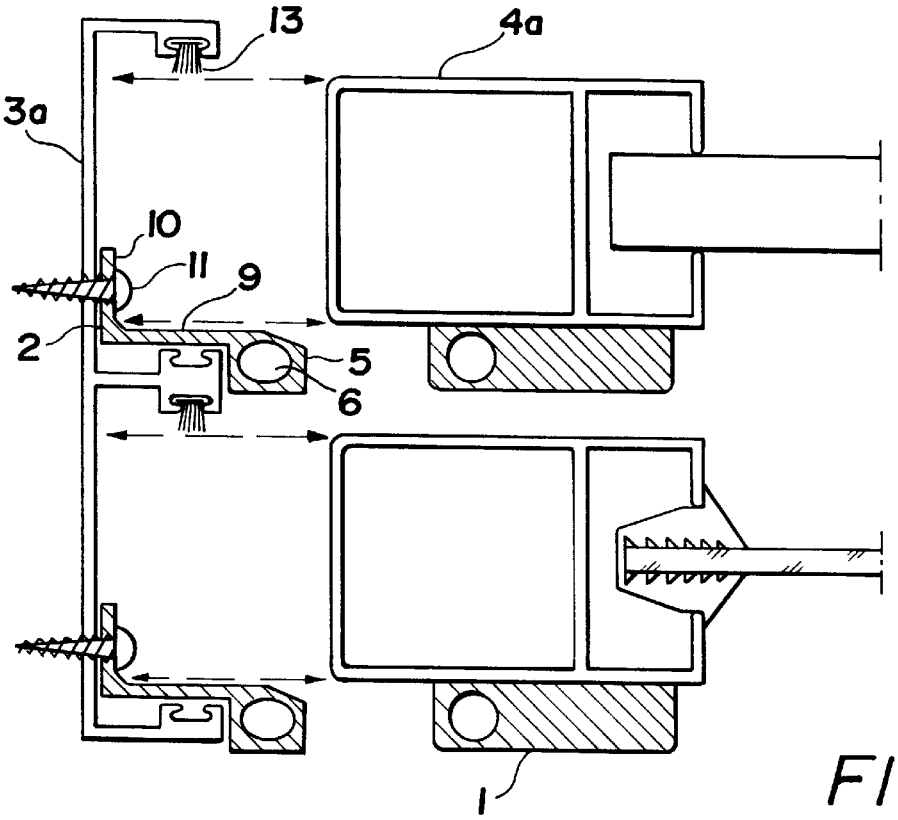
FIG. 2 is a cross section view of a typical door frame as used in standardized aluminum profile series 150 and 700 of double panelled sliding doors, wherein the suggested frame mounted elements are installed within the door frame according to a first embodiment of the invention, co-operating with the external locks which are installed on both sliding door panels.
Figure 3:
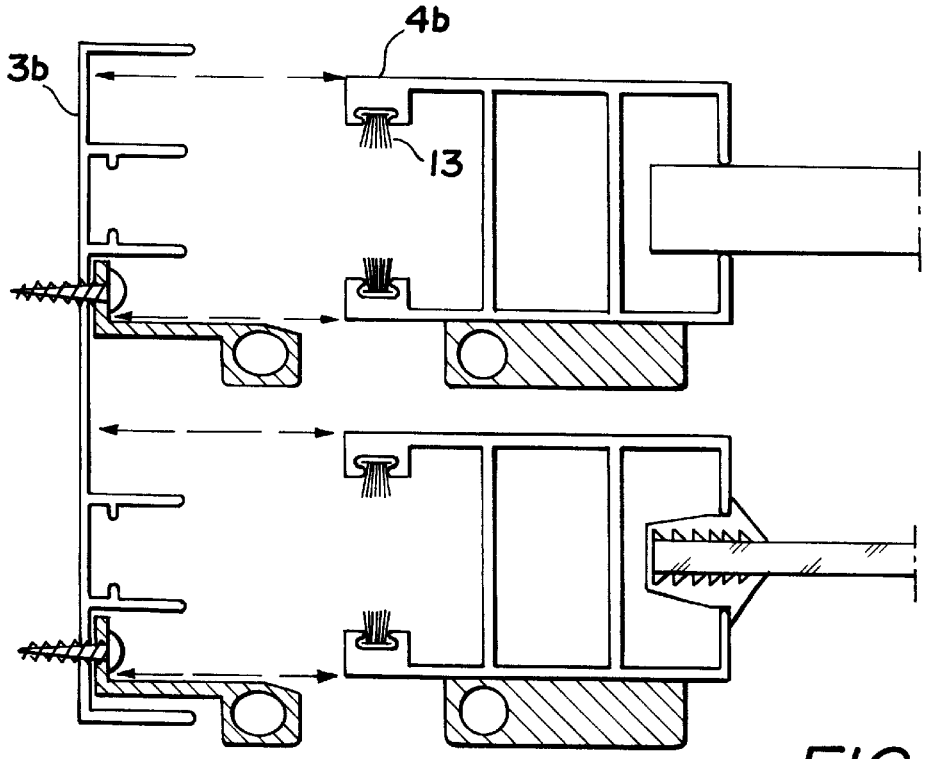
FIG. 3 is a cross sectional view of a typical door frame as used in another standardized aluminum profile for double panelled sliding doors, where the suggested frame mounted elements are installed within the door frame according to an alternative embodiment of the invention, co-operating with the external locks which are installed on both sliding door panels.

Firstly, the frame mounted element 2 proposed in the present invention comprises a generally linear plate 9 of a thickness such as to occupy—particularly at the interior of the typical standard frames of aluminum profile series 150 and 700 denoted by numerals 3*a* and 3*b* in FIGS. 2 and 3 respectively—so much space as is occupied by the projecting therein tightening brush 13. One of the edges and particularly the inner edge of the suggested linear plate 9 is bent to form a perpendicularly disposed angular plate 10, which is in contact with the interior of frame 3*a* or 3*b* and is provided with openings for the passage of screws 11 used for fixing the frame mounted element 2 of the invention onto the door frame 3*a* or 3*b*.

According to a preferred embodiment of the invention, the angular plate 10 is contained inside a cavity of the surface of door frame 3*a* or 3*b*, so that the sliding door panel 4*a* or 4*b* terminates in contact with door frame 3*a* or 3*b* respectively, without coming to an undesirable contact with screws 11.

Furthermore, according to a preferred embodiment of the invention, a self adhesive surface 39 carrying a downy layer and having end projecting members 40*a*, 40*b* can be adjusted onto the interior surface of linear plate 9 of the frame mounted element 2, by means of which satisfactory tightening is accomplished alongside the door frame portion wherein element 2 is fixed.

The outer end of linear plate 9 of the frame mounted element 2 is similarly bent to form a right angle, but at a direction opposite to the one formed by angular plate 10, in order to form a tubular member 5 with a central vertical hole 6 passing therethrough.

The overall height of the frame mounted element 2 and of its tubular member 5 is such as to allow the entire tubular member 5 under consideration to be inserted within a suitably shaped opening of the external lock assembly 1, which is mounted onto the sliding door panel and the position and diameter of central vertical hole 6 passing through tubular member 5 is such as to coincide with the position and diameter of upper and lower sliding bolt member 7*a* and 7*b* of the external lock assembly 1 respectively.

An external lock assembly 1 is fixed onto each sliding door panel 4*a* or 4*b*, the lock assembly 1 having a thickness such that it can be contained within the clearance gap allowed between two parallel sliding door panels in a double panel arrangement (glass and shutter panels) without any problem.

Figure 4:
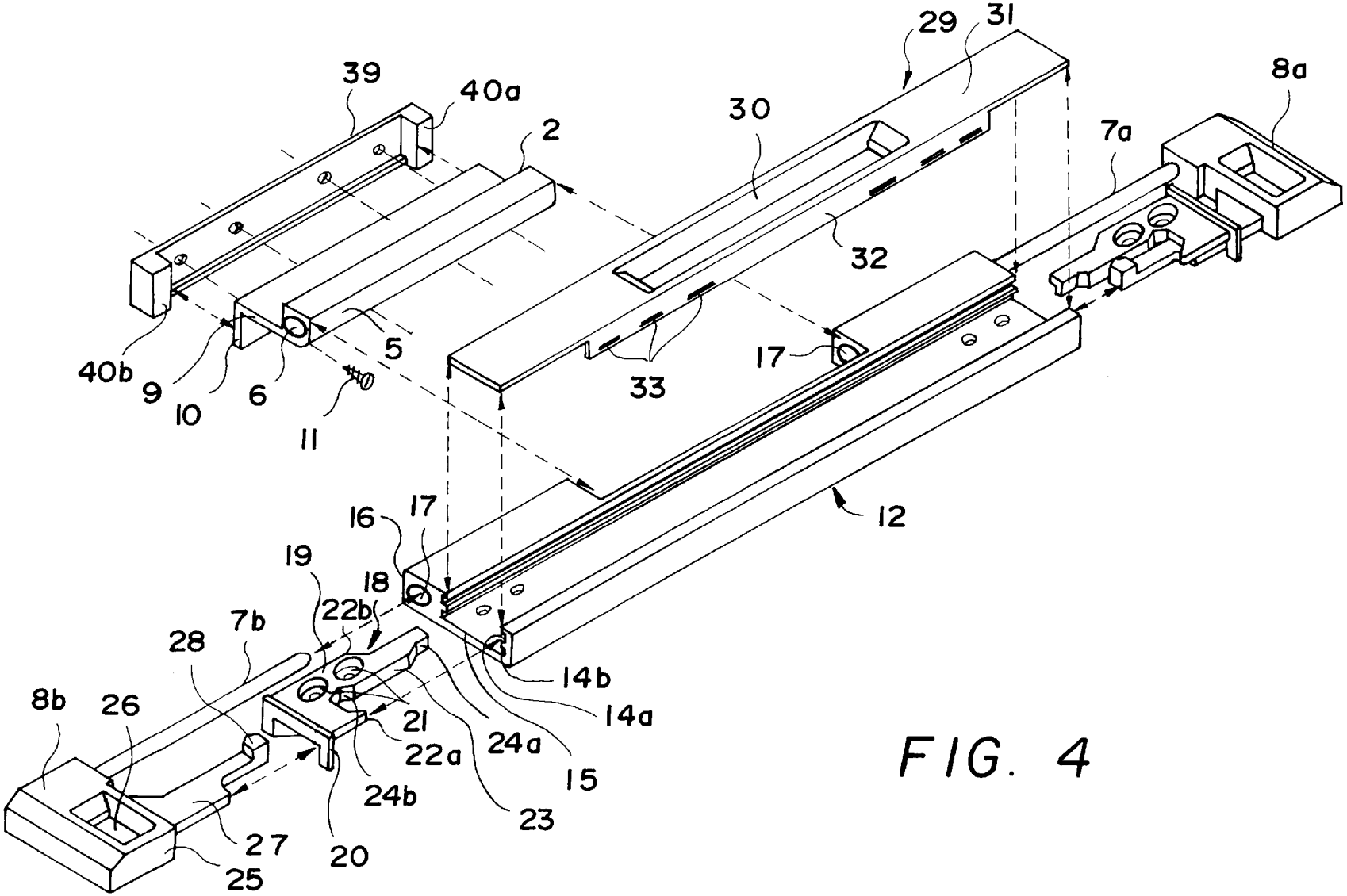

The external lock assembly 1, as shown in FIG. 4, comprises a main body component 12, preferably made of plastic material, a pair of guide blocks 18 installed within main body 12 and a pair of sliding bolt carriages 8*a* and 8*b*, also preferably made of plastic material. The external lock assembly further comprises alternative variations of a covering plug mounted onto the main body and used as a means for gripping and drawing the sliding door panel. Alternative forms of covering plug are denoted by numerals 29 and 34 in FIGS. 4 and 6 respectively.

Firstly, the main body 12 of the external lock assembly 1 comprises a compact tubular portion 16 of a general rectangular cross section with a central hole 17 passing therethrough. The compact tubular portion 16 extends only along a part of the length at the upper and lower ends of main body 12 and a gap is left in between the two end compact tubular portions 16 which is suitable to receive the tubular member 5 of the frame mounted element 2, which is made in precisely the same dimensions as the two end tubular portions 16. Thus, when the lock assembly 1 comes to an engagement relationship with frame mounted element 2, the tubular member 5 of the frame mounted element 2 fits in the gap in between the tubular portions 16 and the central vertical hole 6 of tubular member 5 concides coaxially with the equally sized holes 17 of the end tubular portions 16. Thus it is ensured that sliding bolts 7*a* and 7*b* can pass through the central vertical hole 6 of the frame mounted element 2 after passing through the coaxial holes 17 of end tubular portion 16 at the top and bottom of the lock assembly 1 respectively.

Sideways of the end tubular portions 16, the main body profile 12 of the external lock assembly extends to a longitudinal flat portion, thereby forming an overall Π shaped section. One side of the Π section extends to the tubular upper and lower end portions 16 described above, whereas in the interior other side of the Π section, longitudinal channels 14*a* and 14*b* are provided within which are slidably fitted the abovementioned guide blocks 18.

The locking/unlocking mechanism of the lock assembly of the invention, in accordance to a preferred embodiment of the invention comprises a pair of guide blocks 18 and a pair of sliding bolt carriages 8*a* and 8*b*.

As shown in FIG. 4, each guide block 18 comprises a main body portion 19 with sharp edges 22*a* and 22*b* on each of the sides thereof, which facilitate slidable insertion of the guide block 18 within the Π section 15 of main body 12. The main body portion 19 further comprises a flattened basement portion 20 which is thus sized as to be left outside the Π section 15 of main body 12 when the main body portion 19 is inserted therein. A pair of holes 21 pass through the main body portion 19 of the guide block 18, these holes coinciding with corresponding holes of the Π section 15 when the guide block 18 is inserted therein a pair of bolts pass through holes 21 of the guide block 18 and the corresponding holes of Π section 15 to fix the proposed bolt assembly onto the sliding door panel 4*a* or 4*b*. One side of the guide block 18 comprises a linear side surface 23 with a pair of front and rear recessions 24*a* and 24*b* respectively at the two ends thereof.

Figures 5A, 5B:
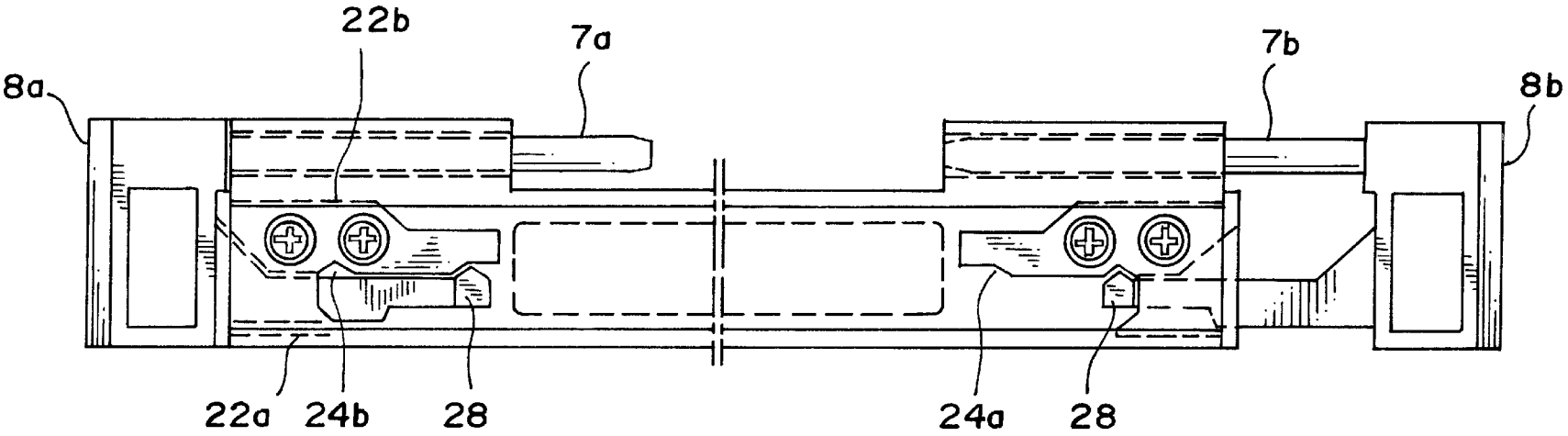
FIG. 5*a* presents a detail of the cooperation of a sliding bolt member of the external lock of the invention with a corresponding receiving housing that is placed within the main body of the external lock, shown at the locked position.
FIG. 5*b* presents a detail of the co-operation of the sliding bolt member of the external lock of the invention with a corresponding receiving housing that is placed within the main body of the external lock, shown at the unlocked position.

The external lock assembly of the invention further comprises, as shown in FIG. 4, a pair of upper and lower sliding bolt carriages 8*a* and 8*b* respectively. Each one of the sliding bolt carriages 8*a* or 8*b* comprises a compact generally rectangular handle portion 25 with an opening 26 facilitating insertion of the hand of the user. A linear plate 27 extends from the rectangular handle portion 25 which is slidable within the lower channel 14*b* provided with Π section 15. Linear plate 27 further extends to an end button formation 28. When the sliding bolt carriage moves back and forth, button 28 moves and is engaged within either recession 24*b* or recession 24*a* of the guide block 18, defining an unlocked and locked condition of the lock assembly as shown in FIG. 5*b* and FIG. 5*a* respectively.

Each one of the sliding bolt carriages 8*a* and 8*b* further comprises a bolt member 7*a* and 7*b* respectively which is slidable within the central holes 17 of tubular end portions 16 and within central hole 6 of the frame mounted element 2, which fills the gap intermediately of the tubular end portions 16.

Following the insertion of guide blocks 18 and sliding bolt carriages 8*a* and 8*b* into the Π section 15 of main body portion 12, Π section 15 is covered by the covering plug 29 depicted in FIG. 4.

Covering plug 29 comprises a flat generally rectangular surface 31 with an overall length and width corresponding to the length and width of Π section 15, whereupon it is fitted. Mounting of the covering plug 29 onto Π—section 15 is effected by means of buttoning a series of protrusions 33 arranged lengthwise on a side surface 32 provided on either side of the flat surface 31 of covering plug 29, into the abovementioned lower channel 14*b* on either side within Π section 15 of the main body 12 of the lock assembly of the invention. A central rectangular cavity 30 is provided in the flat generally rectangular surface 31 of the covering plug 29, by means of which the user can grip and draw the sliding door panel.

Figure 6:
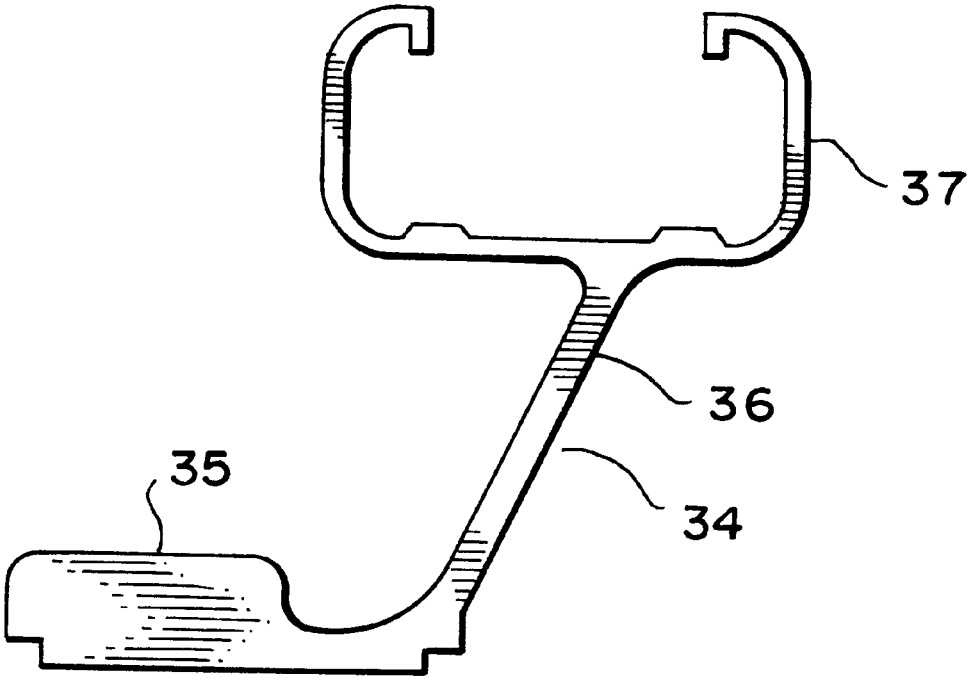
FIG. 6 is the profile of an additional handle used for drawing the sliding panel, that can be adjusted in a buttoned way on the suggested external lock instead of the handle shown in FIGS. 5*a*–5*b*.
Figure 7:
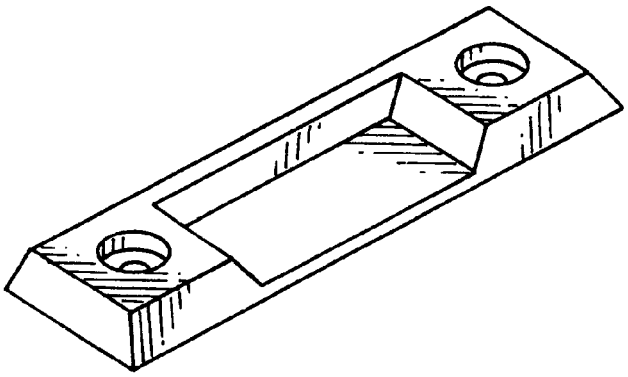
FIG. 7 presents a perspective view of a profile used as an external hollow means for gripping and drawing the sliding door panel.

In accordance to an alternative embodiment of the invention, another type of covering plug may be fitted onto the exterior sliding door panel, which is denoted by numeral 34 in FIG. 6. Such a covering plug comprises a generally rectangular flat surface 35 fitted within Π section 15 of main body 12 of the lock assembly in the same manner as was described hereinabove, a flat preferably inclined surface 36 extending outwards flat surface 35 and ending into a grip portion 37 which is the handle means for drawing the sliding door panel. The exterior of the sliding door panels may finally be fitted with a handle portion as the one depicted in FIG. 7 which is in no way connected to the lock assembly of the invention but is only used as a handle means of the sliding door panel.

Figure 8:
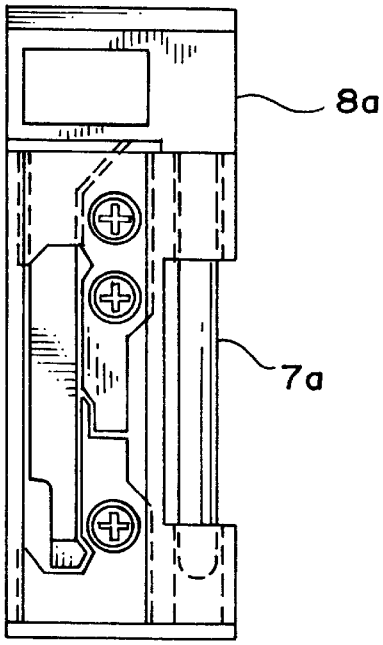
FIGS. 8 and 9 present views of profiles for the external lock of the invention of alternative dimensions with only an upper sliding bolt member, shown at the locked and unlocked position respectively.
Figure 9:
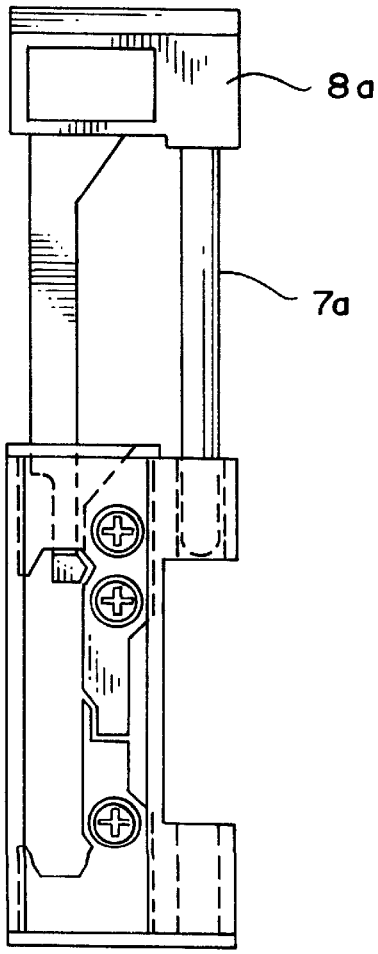

Various alternatives of the external lock assembly of the invention may be developed, such as by way of example the employment of only one upper or lower sliding bolt 7*a* or 7*b* and thereby of only the upper or lower locking/unlocking mechanism with the guide block 18 and sliding bolt carriage 8*a* or 8*b*. Such an arrangement of a lock assembly with a single sliding bolt is depicted in FIGS. 8 and 9, wherein the lock assembly is shown in a locked and unlocked condition respectively. A plurality of lock assemblies of the invention in association with corresponding frame mounted elements can be used along the vertical of the sliding door panel and frame posts to increase the security obtained. Another alternative is to effect the locking/unlocking operation with a single movement, which is achieved if the upper and lower sliding bolt carriages are interconnected by means of extension of the linear plate 27 in the locking/unlocking mechanism.

It must hereby be noted that the invention was hereinabove described by reference to illustrative examples and that it is not confined by them. Thus any change or amendment in the form, dimensions, materials and accessories used, as long as they do not constitute a new inventive step, are considered part of the scope and aims of the present invention.

We claim:

1. External lock assembly (1) for sliding door panels, cooperating with a tubular frame mounted element (2), characterized by that it is suitable for mounting within the limited space available in between a pair of sliding door panels, one glass and one shutter panel, said external lock assembly (1) comprising:

a main body (12) with Π-section profile (15), a pair of upper and lower parallel channels (14*a*) and (14*b*) being provided on either side in the interior of said Π section profile (15), a pair of upper and lower compact tubular members (16) with at least one central hole (17) passing therethrough extending alongside said Π-section profile, an intermediate gap being allowed in between said upper and said lower compact tubular members, a tubular frame mounted element (2) working in cooperating with said external lock assembly (1) beubg futted within said intermediate gap in between said upper and said lower compact tubular members;

at least one locking/unlocking mechanism of said external lock assembly (1), comprising a guide block (18) and a sliding bolt carriage (8), said guide block (18) comprising a main body portion (19) with sharp edges (22*a,b*) slidably inserted into said upper channel (14*a*) of said Π-section profile (15), an end flattened basement portion (20) of said main body portion (19) being left outside Π-section profile (15) when said main body portion (19) is inserted therein, a pair of holes (21) being provided onto said main body portion (19), said holes (21) coinciding with corresponding holes of said Π-section profile (15) when said guide block (18) is inserted therein, wherein a pair of bolts are capable of being used to fixedly connect said main body portion (19) onto said Π-section profile (15) and subsequently onto a sliding door panel which is capable of being used with said external lock assembly, said guide block (18) further being provided with a linear side surface (23) with a pair of front and rear recessions (24*a*) and (24*b*), and wherein said sliding bolt carriage (8) comprises a compact generally rectangular handle portion (25) with an opening (26), a linear plate (27) extending from said rectangular handle portion (25), said linear plate (27) being slidable within said lower channel (14*b*) of said Π section profile (15) and extending to an end button formation (28), wherein said button formation (28) moves along said linear side surface (23) of said guide block (18) and is engaged within either said front recession (24*a*) or said rear recession (24*b*), thereby respectively defining a locked and unlocked condition of said external lock assembly;

a covering plug used to cover said Π-section profile (15), having a handle means for drawing (said) a sliding door panel capable of being used with said external lock assembly, and said frame mounted element (2) working in cooperation with said external lock assembly (1), comprising a generally linear plate (9) of a thickness comparable to the width of a tightening brush which is capable of extending within a sliding door frame post which is capable of being used with said external lock assembly, said generally linear plate (9) being bend at right angles to form at the inner end thereof an angular plate (10), wherein said angular plate (10) is used for fixing said frame mounted element onto the sliding door frame post which is capable of being used with said external lock assembly, said generally linear plate (9) being bent at right angles to form at the outer end therof a tubular member (5) with at least one central vertical hole (6) passing therethrough, wherein said tubular member (5) is inserted during engagement with said external lock assembly in the gap in between said pair of upper and lower compact tubular members (16) and said at least one central vertical hole (6) concides coaxially with said at least one central hole (17) of said tubular members (16) at either end thereof, thereby allowing locking through insertion of upper and lower sliding bolts (7*a*) and (7*b*).

2. External lock assembly (1) for sliding door panels cooperating with a tubular frame mounted element (2), as claimed in above claim 1, wherein said angular plate (10) of said frame mounted element (2) is capable of being located within a recession of the sliding door frame post which is capable of being used with said external lock assembly.

3. External lock assembly (1) for sliding door panels cooperating with a tubular frame mounted element (2), as claimed in above claim 1, wherein said covering plug of said external lock assembly (1) comprises a flat surface (31) with a cavity shaped handle (30) and side surfaces (32) with a series of protrusions (33) which are buttoned within said channel (14*b*) of said Π section profile (15) of said external lock assembly.

4. External lock assembly (1) for sliding door panels cooperating with a tubular frame mounted element (2), as claimed in above claim 1, wherein said covering plug is capable of being mounted at the exterior of the sliding door panel which is capable of being used with said external lock assembly, said covering plug comprising a flat surface (35) fitting within said Π-section profile (15) of said lock assembly, a flat inclined surface (36) extending outwards said flat surface (35) and ending into a handle means (37).

5. External lock assembly (1) for sliding door panels cooperating with tubular frame mounted element (2), as claimed in above claim 1, characterized by that it comprises a pair of an upper and a lower locking/unlocking mechanisms with corresponding upper and lower sliding bolts (7*a,* 7*b*) reciprocatingly moving through movement of sliding bolt carriages (8*a,* 8*b*) respectively.

* * * * *

UNITED STATES PATENT AND TRADEMARK OFFICE

CERTIFICATE OF CORRECTION

PATENT NO. : 5,934,719

DATED : August 10, 1999

INVENTOR(S) : Athanasios Leontaridis

It is certified that error appears in the above-identified patent and that said Letters Patent is hereby corrected as shown below:

Title Page, item [19]"Athanasios" should read --Leontaridis-- and item [76] inventor: should read --Athanasios Leontaridis--.

Signed and Sealed this

Twenty-first Day of December, 1999

*Attest:*

Q. TODD DICKINSON

*Attesting Officer*

*Acting Commissioner of Patents and Trademarks*